US006875160B2

(12) United States Patent
Watterson et al.

(10) Patent No.: US 6,875,160 B2
(45) Date of Patent: Apr. 5, 2005

(54) ELLIPTICAL EXERCISE DEVICE WITH LEAF SPRING SUPPORTS

(75) Inventors: Scott R. Watterson, Logan, UT (US); F. Troy Miller, Logan, UT (US)

(73) Assignee: Icon IP, Inc., Logan, UT (US)

( * ) Notice: Subject to any disclaimer, the term of this patent is extended or adjusted under 35 U.S.C. 154(b) by 278 days.

(21) Appl. No.: 09/943,741

(22) Filed: Aug. 30, 2001

(65) Prior Publication Data

US 2003/0045401 A1 Mar. 6, 2003

(51) Int. Cl.[7] ..... A63B 69/16; A63B 22/12
(52) U.S. Cl. ..... 482/57; 482/52; 482/57
(58) Field of Search ..... 482/51–53, 57–65, 482/70–71, 121, 79–80, 908

(56) References Cited

U.S. PATENT DOCUMENTS 5,322,491 A 6/1994 Wanzer et al. ..... 482/52
5,336,141 A 8/1994 Vittone ..... 482/51
D403,033 S 12/1998 Husted et al. ..... D21/668
6,007,462 A * 12/1999 Chen ..... 482/57
6,146,313 A * 11/2000 Whan-Tong et al. ..... 482/51
6,165,107 A 12/2000 Birrell ..... 482/70
6,217,486 B1 4/2001 Rosenow ..... 482/52
6,277,055 B1 * 8/2001 Birrell et al. ..... 482/52
6,551,217 B2 * 4/2003 Kaganovsky ..... 482/51

* cited by examiner

*Primary Examiner*—Stephen R. Crow
(74) *Attorney, Agent, or Firm*—Workman Nydegger

(57) ABSTRACT

An elliptical exercise apparatus including a frame, a crank, a pair of guide tracks, and a pair of flexibly resilient foot supports that provide elliptical exercises. Each foot support comprises a leaf spring and a foot engagement pad configured to receive the foot of a user. The foot engagement pads rotate in elliptical paths and the leaf springs flex in varying degree to accommodate for varying forces and gaits of different users. The leaf springs provide upward biasing forces in direct response to sudden and irregular downward forces, thereby flexing to improve the feel of the exercise.

23 Claims, 5 Drawing Sheets

ELLIPTICAL EXERCISE DEVICE WITH LEAF SPRING SUPPORTS

BACKGROUND OF THE INVENTION

1. The Field of the Invention

The present invention relates to exercise equipment and, more specifically, to exercise devices that produce elliptical foot displacement.

2. The Prior State of the Art

In the field of exercise equipment, a variety of devices have been developed to strengthen and condition leg muscles commonly used for such activities as walking, running, climbing, jumping, skiing etc. Such machines include treadmills, stepping machines, and various types of sliding machines. Elliptical exercise machines have also proven to be popular exercise products.

Elliptical exercise devices provide a low impact exercise requiring a wide range of motion. However, typical elliptical exercise machines can be somewhat inflexible. In particular, forces applied on existing elliptical exercise devices are rigidly channeled into the elliptical movement of the foot supports along predefined elliptical paths. Although the predefined paths can be substantially similar to those commonly encountered during typical ambulation, they typically do not accommodate variations in gaits and strides of different users.

Accordingly, there is currently a need in the art for an improved elliptical exercise apparatus.

OBJECTS AND SUMMARY OF THE INVENTION

It is accordingly one object of the present invention to provide an improved exercise apparatus.

It is another object of the invention to provide an improved elliptical exercise apparatus.

It is another object of the invention to provide an elliptical exercise apparatus configured to accommodate different gates of different users.

It is another object of the invention to provide an elliptical exercise apparatus having flexible foot supports.

The present invention is directed to an improved elliptical exercise apparatus for providing low impact exercise over a wide range of motion. The elliptical apparatus features a foot support comprising a spring. The elliptical exercise apparatus generally accommodates variations in gaits between different users and enables the user to experience a low impact bounce dynamic.

According to one embodiment, the elliptical exercise apparatus of the invention comprises a frame, a crank, a pair of guide tracks, a pair of arm supports, and a pair of spaced apart foot supports.

The foot supports each comprise front and back ends, a leaf spring, and a foot engagement pad. The foot engagement pads are configured for receiving and engaging the user's feet and are mounted on top of the corresponding leaf springs. The leaf springs flex under the weight of the user and in direct response to the downward forces applied by the user. The flexibility of the springs is determined in part by the magnitude of force that is applied by the user. The elliptical exercise apparatus generally accommodates variations in gaits of different users by providing leaf springs that flex in varying degrees in response to the various magnitudes of force that are applied by different users.

The leaf springs enable the user to experience a low impact bounce during use. This is a unique and novel achievement in the field of elliptical devices and enhances the feel of the simulated ambulation. The bounce dynamic is achieved when the leaf springs release stored spring energy and apply upward forces that press against the user's feet. It will be appreciated that this is an improvement over existing elliptical exercise devices that channel forces exclusively into elliptical rotation.

In one embodiment, one end of each foot support is pivotably connected to an arm support. The arm supports are examples of means for supporting the arms of a user. An opposing end of each leaf spring is coupled to a crank. The crank is an example of means for enabling elliptical movement of the foot supports.

According to one embodiment, the front end of each foot support includes a roller which rollably engages a corresponding guide track. The guide tracks are fixedly attached to the frame and are examples of means for elevating the foot supports. In particular, the guide tracks may be affixed on an incline. However, the guide tracks may also lie flat and parallel with the ground surface. The guide tracks may also be straight or curved. During use, the front end of each foot support is forced to reciprocate along its corresponding guide track in general response to the displacement of the foot support about the crank. The combined rotational and linear displacement of the foot supports generally causes the foot engagement pads to rotate in elliptical paths.

As mentioned above, in one embodiment, the elliptical exercise apparatus also comprises a pair of arm supports. In one preferred embodiment, each of the arm supports comprises first and second poles that are slidably engaged. The first pole is pivotally connected to the frame and the second pole is pivotally connected to the corresponding foot support. During use, the second pole slides in and out of the first pole, thereby enabling the arm supports to pivot at both the frame and at the connection thereby with the foot supports.

According to one alternative embodiment of the invention, each of the arm supports comprises a single pole that is pivotally connected to the frame and to the front end of a corresponding foot support. According to one such alternative embodiment, the elliptical exercise apparatus does not comprise guide tracks or rollers. Instead, the front end of each foot support swings freely in the air, supported only by the corresponding arm supports. Optionally, no arm supports are employed.

One benefit of the invention is that the elliptical exercise apparatus is able to accommodate variations in gaits of different users by providing leaf springs that flex and deflect sudden and irregular forces applied by different users. Another benefit of the invention is that the leaf springs enable the user to bounce in a low impact manner. These and other benefits, features, and advantages of the present invention will become more fully apparent from the following description and appended claims, or may be learned by practicing the invention as set forth below.

BRIEF DESCRIPTION OF THE DRAWINGS

A more extensive description of the present invention, including the above-recited features and advantages, will be rendered with reference to the specific embodiments that are illustrated in the appended drawings. Because these drawings depict only exemplary embodiments, the drawings should not be construed as imposing any limitation on the present invention's scope. As such, the present invention will be described and explained with additional specificity and detail through use of the accompanying drawings in which.

DETAILED DESCRIPTION OF THE PREFERRED EMBODIMENTS

The improved elliptical exercise apparatus of the present invention is configured to provide low impact exercise while accommodating variations in gaits between different users. The apparatus enables the user to experience a low impact bounce, thereby enhancing the simulated ambulatory exercise.

Figure 1:
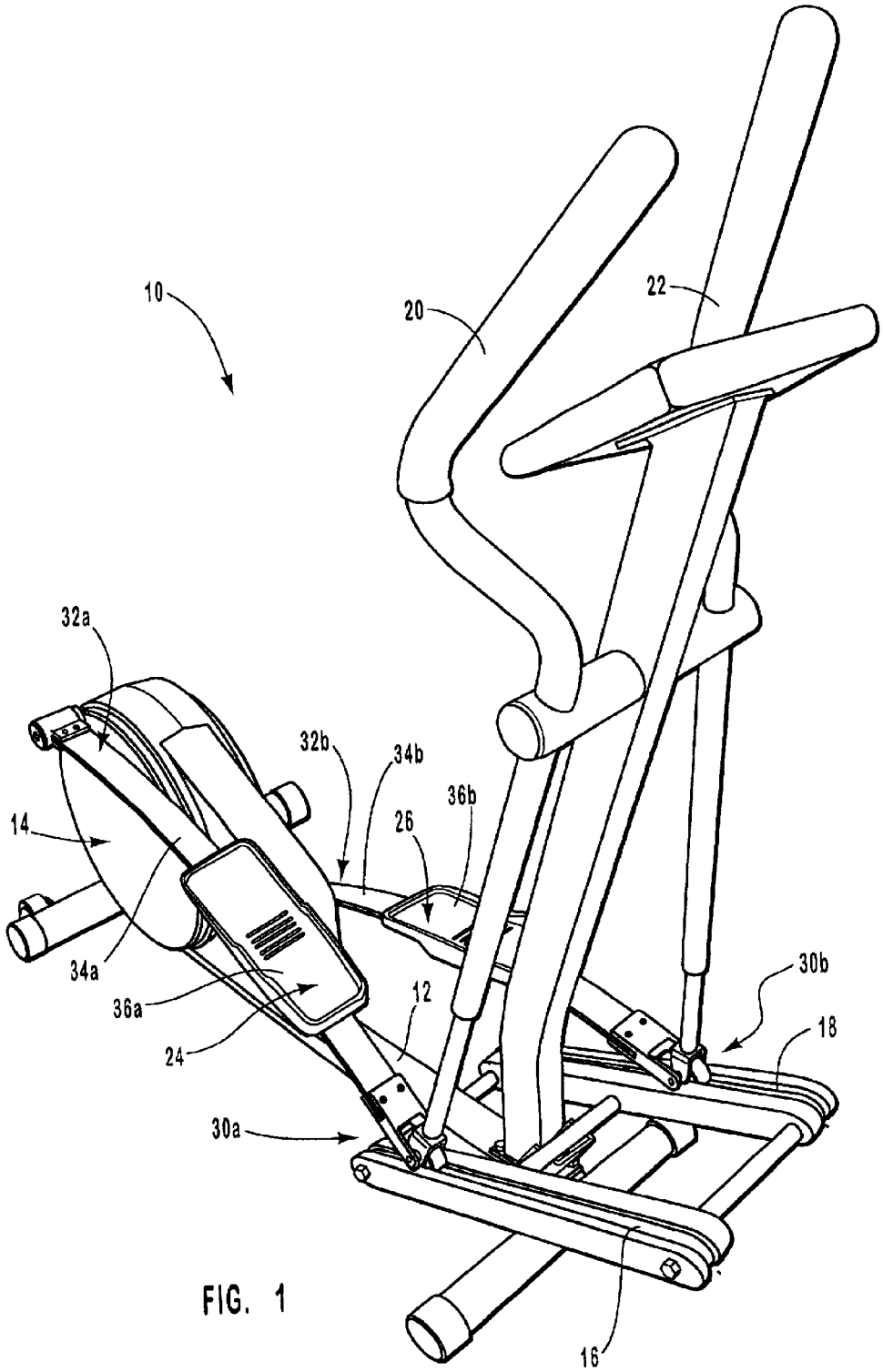
FIG. 1 is a perspective view of one embodiment of the elliptical exercise apparatus of the invention that includes flexible foot supports pivotally connected to (i) telescoping arm supports and (ii) a crank. Rollers rollably engage sloped guide tracks.

According to one embodiment, as shown in FIG. 1, the elliptical exercise apparatus 10 comprises a frame 12, a crank 14, two guide tracks 16 and 18, two arm supports 20 and 22, and two spaced apart foot supports 24 and 26. Foot supports have a front end 30*a–b*, and a back end 32*a–b*.

The foot supports 24 and 26 each comprise: (i) a flexibly resilient member, such as leaf spring 34*a–b* and (ii) a foot engagement pad 36*a–b*, respectively. The foot engagement pads 36*a–b* are configured for receiving and engaging the user's feet and are mounted on top of the corresponding leaf springs 34*a–b*. The foot engagement pads 36*a–b*, which are preferably composed of a plastic material that is lightweight and durable, can be attached to the leaf springs 34*a–b* with bolts, clamps, screws, adhesives, epoxies, or any other suitable connecting means. According to one embodiment, the foot engagement pads 36*a–b* are secured to the corresponding leaf springs 34*a–b* by bolts that pass through holes in corresponding leaf springs 34*a–b*.

Figure 2:
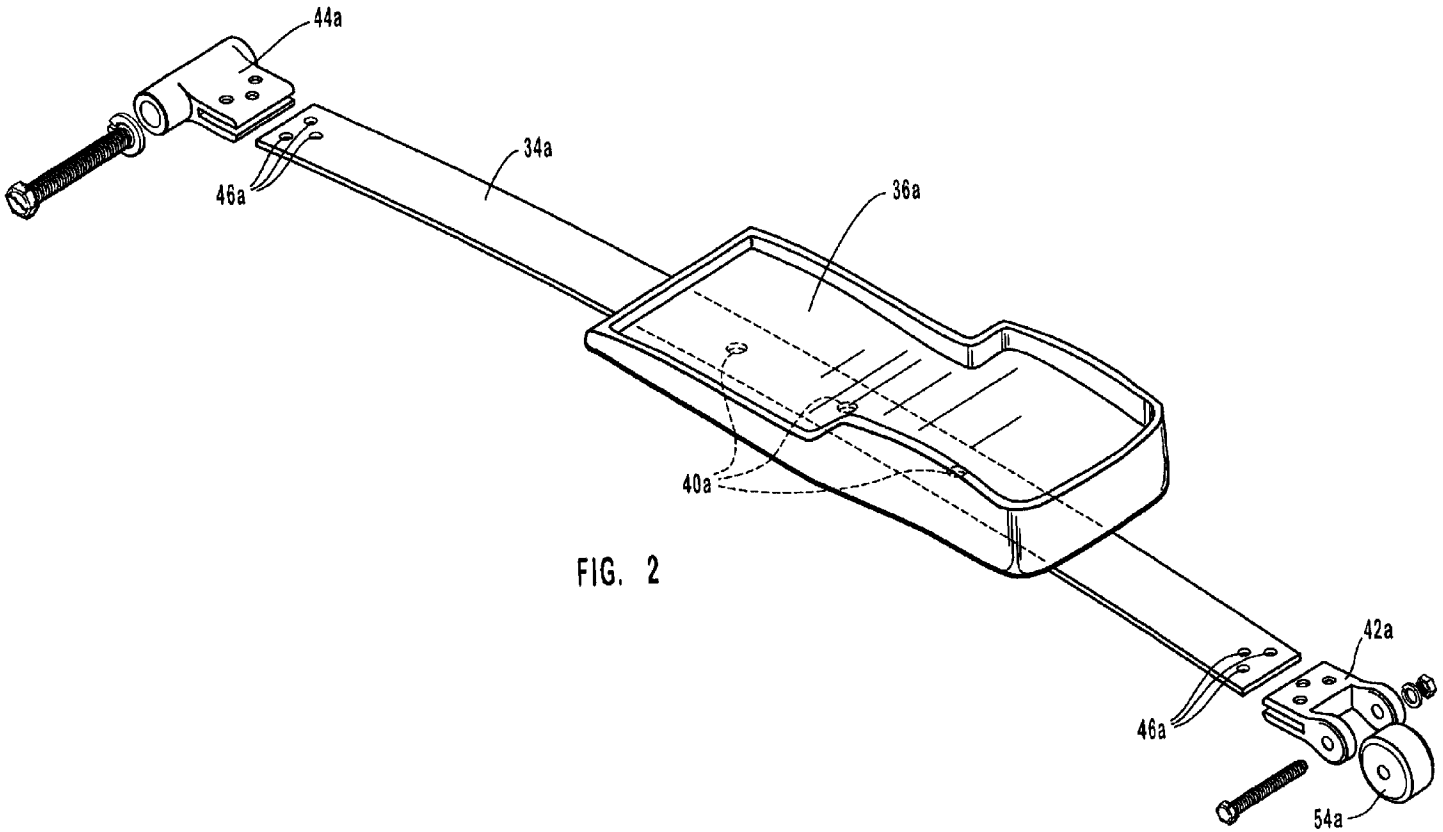
FIG. 2 is a perspective, exploded view of one embodiment of a foot support of the elliptical exercise apparatus of FIG. 1.

Each leaf spring may comprise a single hole for mounting the foot engagement pad or multiple holes 40*a*, as shown in FIG. 2. Multiple holes 40*a* are useful for enabling the foot engagement pad 36*a* to be selectively mounted on the leaf spring 34*a* in a variety of different locations to suit specific user preferences. To further facilitate positioning of the foot engagement pads 36*a–b*, each foot engagement pad 36*a–b* may also comprise independently movable and securable parts, which may incorporate internal tracks and clamps, for example, to enable the foot engagement pad 36*a–b* to be placed into different positions or alignments. Each foot engagement pad 36*a–b* may also comprise a hinge, for enabling the foot engagement pad 36*a–b* to be hingedly attached to the corresponding leaf spring 34*a–b*. According to yet another embodiment, the foot engagement pad 36*a–b* may comprise straps for securing the user's foot to the foot engagement pad 36*a–b* during use.

Each leaf spring 34*a–b* is preferably bowed and is configured to flex under the weight of the user and in direct response to downward forces applied by the user during use of the elliptical exercise apparatus. The leaf springs 34*a–b* flex and bend in response to sudden and/or irregular forces, thereby responding conformingly to various forces that are applied by different users with different gaits. It will be appreciated that this enables the leaf springs 34*a–b* to accommodate variations in gaits of different users.

The flex of the leaf springs 34*a–b* also enables the user to bounce, thereby enhancing the feel of the simulated ambulation during exercise. In particular, a bounce dynamic is fostered when the leaf springs 34*a–b* apply upward forces that press against the user's feet. These upward forces are created when the leaf springs 34*a–b* release stored spring energy that is created and stored by the leaf springs 34*a–b* when they are compressed to accommodate the sudden and/or irregular forces that are applied by the user. It will be appreciated that the functionality of the leaf springs 34*a–b*, as described, provide several improvements over typical existing elliptical exercise devices.

The amount in which each leaf spring 34*a–b* flexes or deflects is in part a function of the magnitude of the force that is applied by the user. The flex of the leaf spring 34*a–b* is also, in part, a function of the shape and material composition of the leaf spring 34*a–b*.

According to one preferred embodiment, the leaf spring 34*a–b* is composed of SAE5160H hot rolled steel. It will be appreciated, however, that each leaf spring 34*a–b* may be composed of any suitably strong and flexible material, including, but not limited to materials such as spring steel and steel alloys, titanium, plastic, reinforced plastic, molded plastic, fiberglass, carbon fiber, Kevlar, other composites, and/or wood. The leaf springs of the invention may be manufactured according to any suitable process, including, but not limited to casting, forging, and extrusion. In one embodiment, the leaf spring(s) is made from a molded reinforced plastic. In another embodiment the leaf spring(s) is an extruded fiberglass spring. Each leaf spring 34*a–b* may also comprise a standard automobile spring. Car springs are well known in the art.

The dimensions of leaf spring 34 may vary. In one embodiment, the width of the leaf spring 34 is within a range of approximately 2 inches to approximately 3 inches, e.g., approximately 2.5 inches. In one embodiment, the thickness of the leaf spring 34, is within the range of approximately ¼ of an inch to approximately ½ of an inch, e.g., approximately 0.3 inches, for example. It will be appreciated, however, that the thickness and width of the leaf spring 34 may vary significantly to accommodate different material compositions and to provide various ranges of flexibility. The leaf springs, as they have been described, comprise one suitable means for flexibly deflecting force from a user.

According to one embodiment of the invention, each foot support further comprises respective pivoting connectors 42*a–b*, 44*a–b*, each of which are examples of (i) means for pivotally coupling a respective leaf spring to (i) the crank 14; or (ii) respective arm supports 20 and 22. Connectors 42*a–b*, 44*a–b* are attached to the opposing ends of respective leaf springs 34*a–b*. Pivoting connectors 42*a–b* and 44*a–b* may comprise bearings, bushings, slip sleeves, or any combination of the above, for example. The pivoting connectors 42*a–b* and 44*a–b* may also be configured with holes for receiving and securing bolts or rods that are rotatably connected to bearings, bushings, slip sleeves, or any combination of the above. The pivoting connectors 42*a–b* and 44*a–b* may be secured to the respective leaf springs 34*a–b* with bolts, screws, clamps, adhesives, and/or by welding or any other suitable connecting means.

According to one embodiment, as shown in FIG. 2, holes 46*a* are formed in the leaf spring 34*a* and the pivot connectors 42*a* and 44*a*, through which bolts or screws can pass to secure the pivot connectors 42*a* and 44*a* to the respective leaf spring 34*a*.

According to an alternative embodiment, the pivoting connectors are integrally connected with their respective leaf springs (and optionally to the foot engagement pad). By way of example and not limitation, in one embodiment, the front and rear pivot connectors 42*a* and 44*a*, leaf spring 34*a*, and foot engagment pad 36*a* of each foot support are manufactured as a one-piece unit in a single casting process, e.g., a molding process in which a plastic or fiberglass material is employed. Optionally, (i) the front and rear pivot connectors and leaf spring are manufactured as a one-piece unit in a single casting process; or (ii) the foot engagement pad and leaf spring are molded as a one-piece unit in a single casting process.

Figure 3:
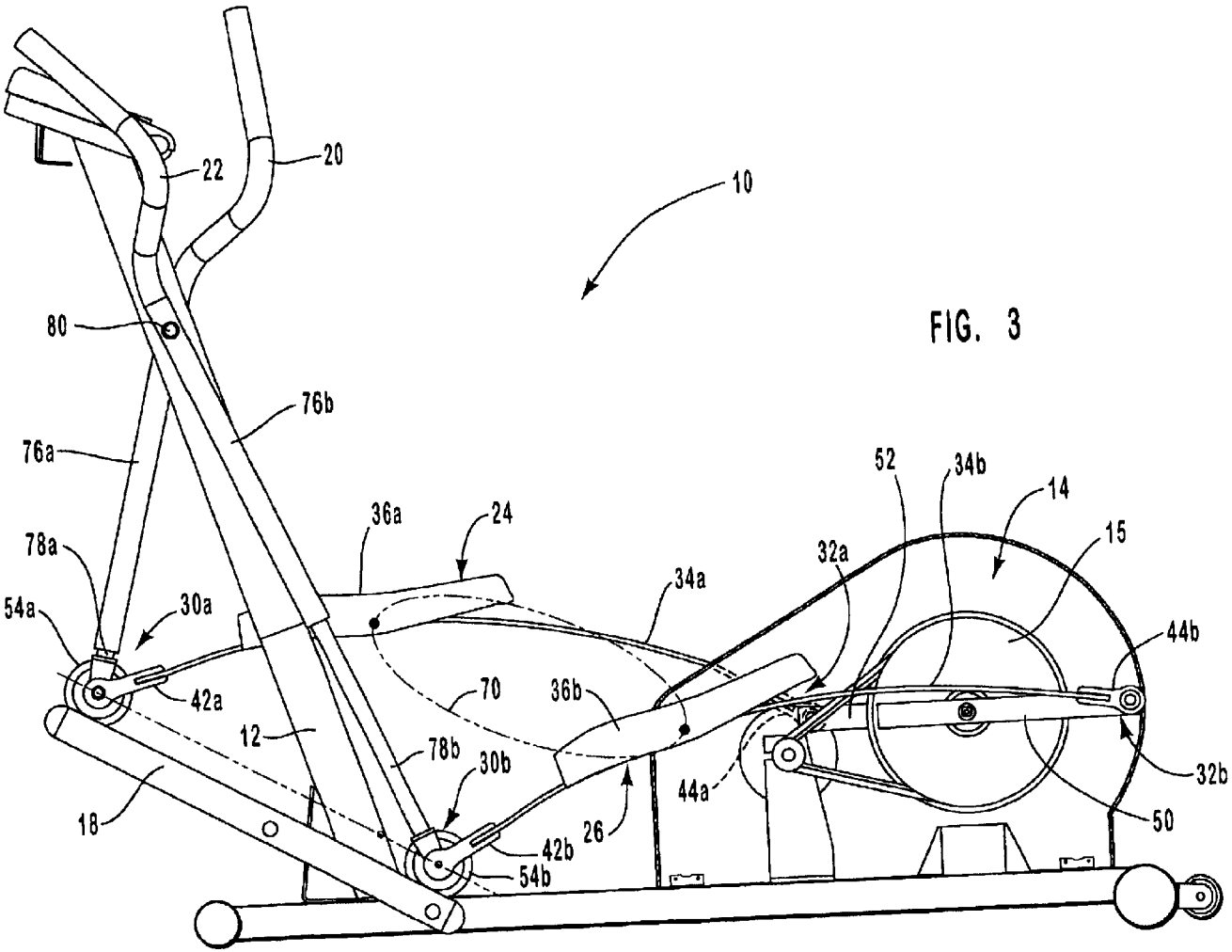
FIG. 3 is a side illustration of one embodiment of the elliptical exercise apparatus of FIG. 1.
Figure 5:
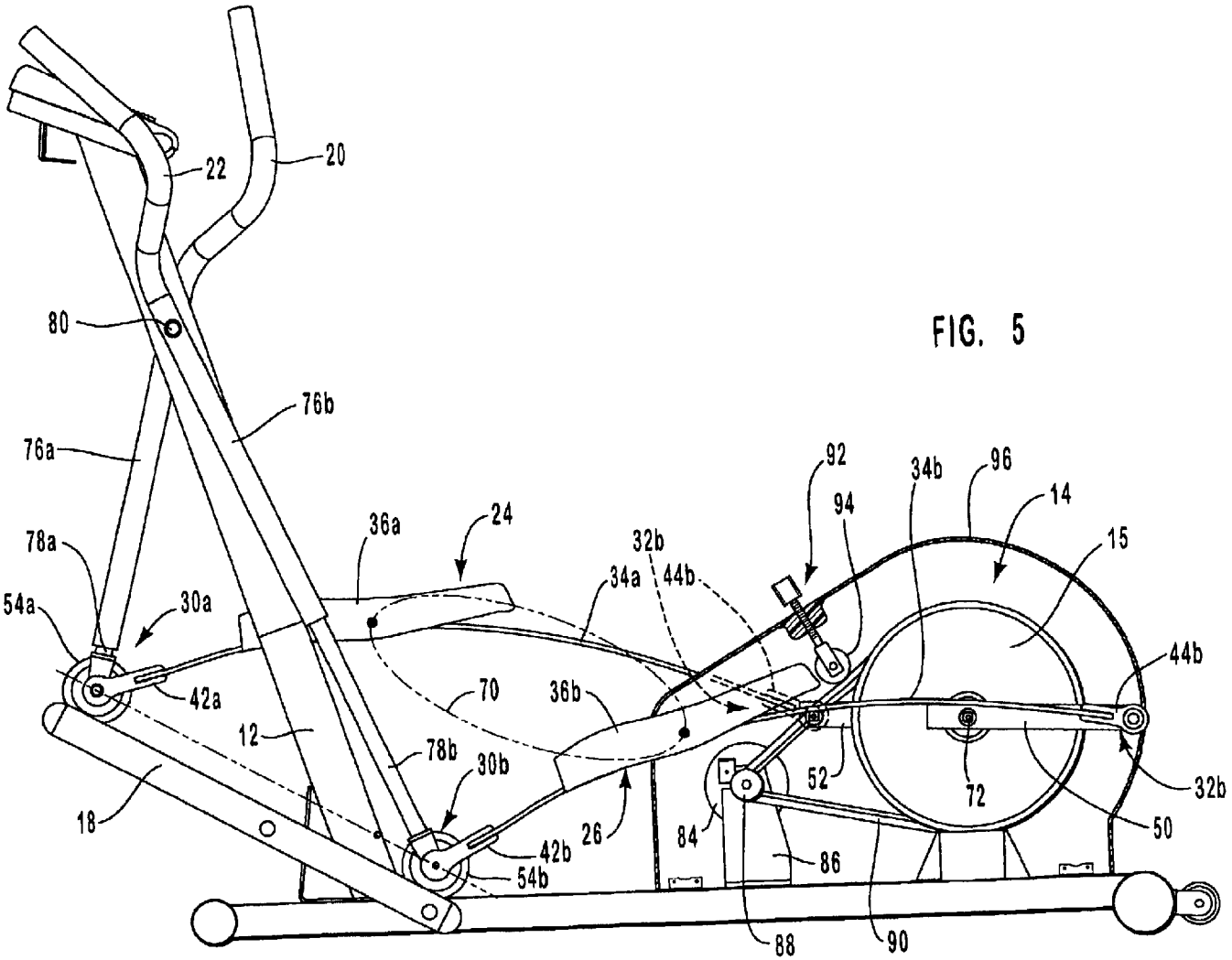
FIG. 5 is a side illustration of one embodiment of the elliptical exercise apparatus of the invention that illustrates (i) a crank; and (ii) a flywheel assembly, which is an example of means for conserving momentum.

As illustrated in FIGS. 3 and 5, the back end 32*a–b* of each foot support 24 and 26 is rotatably connected, through the use of a respective pivot connector 44*a–b*, to a different one of two crank arms 50 and 52, each of which are each axially connected to and project orthogonally away from crank 14 in opposite directions. The crank arms 50 and 52 are located on opposite sides of flywheel 15 of crank 14 and rotate with flywheel 15 about a central axis 72. During use, the user applies force to foot supports 24 and 26 at respective engagement pads 36*a–b* which causes the back ends 32*a–b* of foot supports 24 and 26 to rotate in circular paths about crank 14 as a result of being pivotally attached to respective crank arms 50 and 52.

FIGS. 1 and 3–5 also show how the front ends 30 of foot supports 24 and 26 are pivotally connected to respective arm supports 20 and 22. The arm supports 20 and 22 are also pivotally connected to the frame 12. According to the present embodiment, as shown in FIGS. 3 and 5, the front end 30*a–b* of each foot support 24 and 26 includes a respective roller 54*a–b* (coupled to respective pivoting connectors) that rollably engages a corresponding one of the guide tracks 16 and 18. Guide track 16 is shown in FIG. 1. Guide tracks 16 and 18 are fixedly attached to frame 12 on a slope or incline, e.g., within a range of approximately 10° to approximately 35°, such as an angle of about 29° or about 30°, for example. It will be appreciated, however, that guide tracks 16 and 18 may lie flat and parallel with the ground surface. It will also be appreciated that guide tracks 16 and 18 may be straight or curved. During use, the front end 30*a–b* of each foot support 24 and 26 reciprocates along its corresponding guide track 16 and 18 in general synchronization with the rotational displacement of the back ends 32*a–b* of the foot supports 24 and 26 about the center axis 72 of the crank 14. The front end 30*a–b* of each foot support 24 and 26 is also displaced along the corresponding guide tracks 16 and 18 in response to sudden and/or irregular forces applied by the user that cause the leaf springs 34*a–b* to flex or bend.

During use, the foot engagement pads 36*a–b* typically rotate about the substantially elliptical path 70, which is shown in FIG. 3. This substantially elliptical path 70 is generated by the combined rotational and linear displacement of the foot supports 24 and 26, as described above. It will be appreciated that the shape and size of the substantially elliptical path 70 may vary according to a variety of different functions, such as the different slopes of the guide tracks 16 and 18, the location of the foot engagement pads 36*a–b* on the leaf springs 34*a–b*, the bow in the leaf springs 34*a–b*, and the distance of the crank arms 50 and 52 from the center axis 72 of the crank 14. It should also be appreciated that the foot engagement pads 36*a–b* may deviate from the substantially elliptical path 70 as the leaf springs 34*a–b* flex and bend to accommodate the various forces that are applied, during use, such as when the elliptical exercise apparatus 10 is used by different users with different gaits.

FIG. 3 also illustrates how, according to one present embodiment, arm supports 20 and 22 pivot at the frame 12 and telescope to accommodate displacement of the foot supports 24 and 26 along the corresponding guide tracks 16 and 18. The arm supports 20 and 22, which comprise one example of suitable means for supporting the arms of a user, can also generally assist the user with stability and coordination during operation of the elliptical exercise apparatus 10. According to one embodiment, each of the arm supports 20 and 22 comprises two poles 76*a–b* and 78*a–b* that are slidably engaged. Each first pole 76*a–b* is pivotally connected to the frame 12 at a first pivot point 80 and each second pole 78*a–b* is pivotally connected to a respective pivot connector 42*a–b* of the corresponding foot supports 24 and 26. During use, each second pole 78*a–b* slides in and out of the respective first pole 76*a–b*, thereby enabling the arm supports 20 and 22 to pivot at both the frame 12 and at the foot supports 24 and 26 while the front end 30*a–b* of each foot support 24 and 26 rollably engages the corresponding guide tracks 16 and 18.

Figure 4:
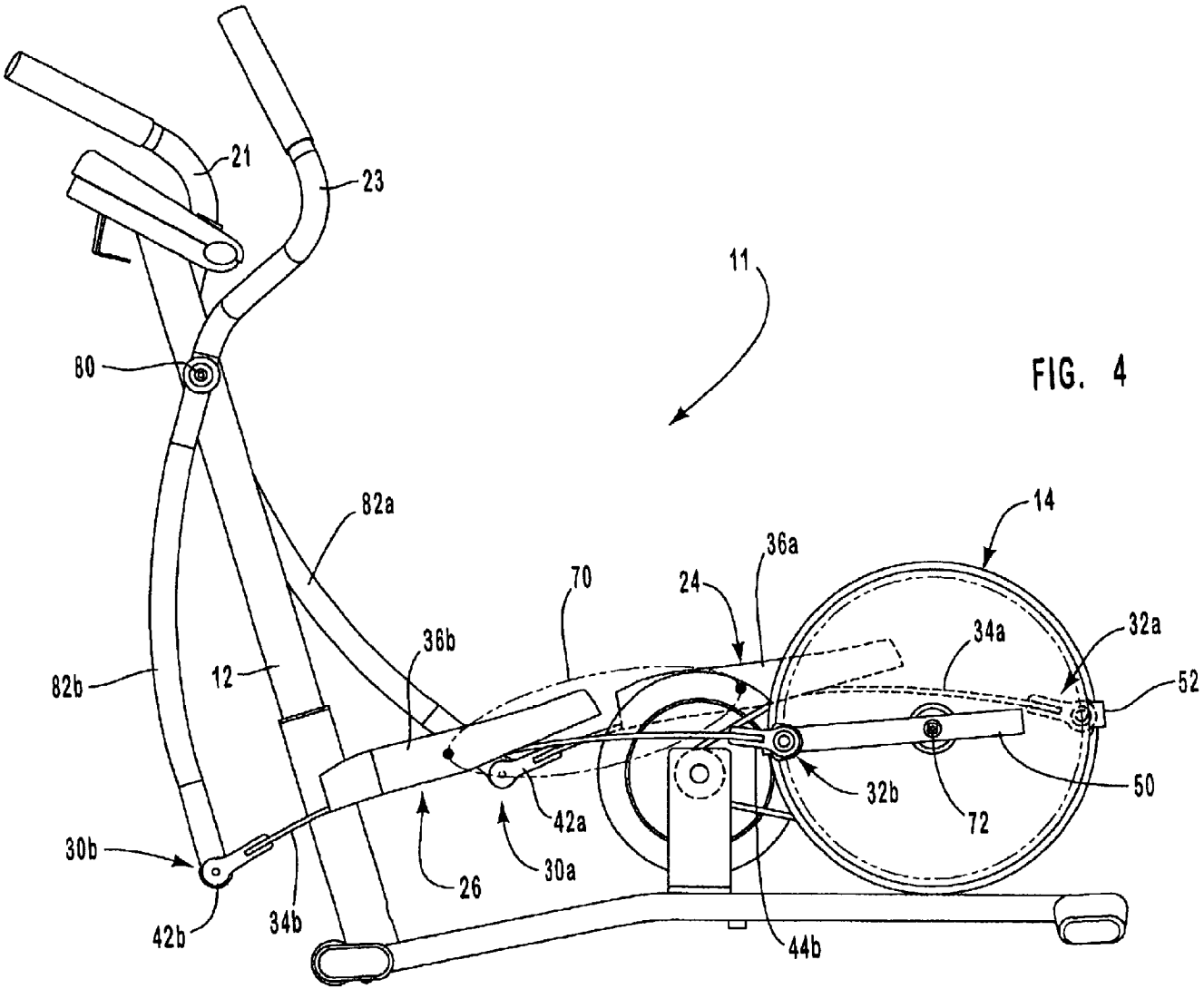
FIG. 4 is a side illustration of one embodiment of an elliptical exercise apparatus of the invention that includes flexible foot supports pivotally connected to (i) arm supports; and (ii) a crank.

FIG. 4 illustrates one alternative embodiment of the elliptical exercise apparatus 11 of the invention. As shown in this alternative embodiment, each of the arm supports 21 and 23 comprises a single pole that is pivotally connected to the frame 12 and to the front end 30*a–b* of a corresponding one of the two foot supports 24 and 26. According to this embodiment, the elliptical exercise apparatus 11 does not comprise guide tracks or rollers. Rather, as shown, the front end 30*a–b* of each foot support 24 and 26 swings freely in the air, being supported only by the corresponding arm supports 20 and 22.

During use, each of the foot engagement pads 36*a–b* travel in a substantially elliptical path 70 as a combined result of the rotational movement of the back ends 32*a–b* of the foot supports 24 and 26 about the center axis 72 of the crank 14 and the displacement of the front ends 30*a–b* of the foot supports 24 and 26, which oscillate back and forth. The foot engagement pads 36*a–b* may deviate from the substantially elliptical path 70 shown when the leaf springs 34*a–b* accommodatingly bend in response to the various forces that are applied during use and by different users.

According to one preferred embodiment of the invention, shown in FIG. 5, the elliptical exercise apparatus 10 comprises a weighted wheel 84. Weighted wheel 84 is rotatably attached to the frame 12 by a bracket 86. A drive wheel 88 is attached on one side of the weighted wheel 84 in axial alignment with the weighted wheel 84. A belt 90 looping around the crank flywheel 15 and the drive wheel 88 causes simultaneous rotation of the crank flywheel 15, the drive wheel 88, and the weighted wheel 84. Once weighted wheel 84 begins to rotate, the force produced by the weighted wheel 84 is transferred back to the flywheel 15 of the crank 14. It will be appreciated that weighted wheel 84 and flywheel collectively make up a flywheel assembly that comprises one suitable means for conserving momentum generated by rotation of the crank 14 and helps maintain even and continued reciprocating displacement of the foot supports 24 and 26. The Weighted wheel 84 is preferably housed within a protective covering 96.

To control the transfer of the force back to the flywheel 15, a tension arm 92 with a wheel 94 biased against the belt 90 can be loosed or tightened. The tension arm 92 and wheel 94 comprise one suitable means for providing resistance while operating the elliptical exercise apparatus 10. In particular, tightening the tension arm 92 and forcing the wheel 94 against the belt 90, increases frictional forces that resist the movement of the belt 90, rotation of the wheels 15, 84, 88 and 94, and reciprocating displacement of the foot supports 24 and 26.

According to an alternative embodiment, no pivoting arm supports (such as supports 20 or 22 or supports 21 or 23) are employed. In one such embodiment, the rollers coupled to the front portions of respective leaf springs roll on respective tracks without the leaf springs being coupled to supports at the front end thereof. This embodiment may be desirable for enabling a user to simulate running exercise without resting the user's arms on the handle portions of moving arm supports. A fixed handle may be coupled to the frame, for example, to support the user's arms if necessary.

According to another alternative embodiment, rather than having upper, moving handle portions for grasping by a user, supports 20 and/or 22 (or supports 21 and/or 23) only extend between respective pivoting connectors 42*a*, 42*b* and the pivot point 80 of the frame 12. This embodiment may optionally be desirable for enabling a user to simulate running exercise without resting the user's arms on moving handle portions of arm supports. A fixed handle may be coupled to the frame, for example, to support the user's arms if necessary.

It should also be appreciated that the present invention may be embodied in other forms without departing from its spirit or essential characteristics. As properly understood, the preceding description of specific embodiments is illustrative only and in no way restrictive. The scope of the invention is, therefore, indicated by the appended claims as follows.

What is claimed and desired to be secured by United States Letters Patent is:

1. An elliptical exercise apparatus comprising:

a frame;

first and second foot supports, wherein each of said first and second foot supports comprises a leaf spring for flexibly deflecting force applied by a user operating the elliptical exercise apparatus; and means coupled to the frame and the foot supports for enabling elliptical movement of the first and second foot supports.

2. An elliptical exercise apparatus as defined in claim 1, wherein the material composition of the leaf spring comprises at least one of plastic, fiberglass, wood, and metal.

3. An elliptical exercise apparatus as defined in claim 1, wherein means for enabling elliptical movement comprises a crank, and wherein said crank is pivotally connected to said frame and said first and second foot supports.

4. An elliptical exercise apparatus as defined in claim 1, further comprising means for elevating said first and second foot supports.

5. An elliptical exercise apparatus as defined in claim 4, wherein the means for elevating said first and second foot supports comprises sloped guide tracks fixedly attached to the frame, and wherein said first and second foot supports are configured with rollers for rolling on said sloped guide tracks.

6. An elliptical exercise apparatus as defined in claim 1, further comprising means for supporting a user's arms.

7. An elliptical exercise apparatus as defined in claim 6, wherein the means for supporting a user's arms comprises a first pole and a second pole, and wherein the first pole is pivotally connected to both the frame and the first foot support and the second pole is pivotally connected to both the frame and the second foot support.

8. An elliptical exercise apparatus as defined in claim 1, wherein the leaf spring for flexibly deflecting force comprises a flexibly resilient member.

9. An elliptical exercise apparatus comprising:

a frame;

first and second foot supports, wherein each of said first and second foot supports comprises a leaf spring, and wherein said leaf spring is configured to flexibly displace force applied by a user operating the elliptical exercise apparatus; and a crank coupled to the frame and the first and second foot supports, wherein said crank is pivotally connected to each of said first and second foot supports such that each of the first and second foot supports moves in a substantially elliptical path.

10. An elliptical exercise apparatus as defined in claim 9, further comprising first and second guide tracks, and wherein said first and second foot supports are mounted on said first and second guide tracks respectively.

11. An elliptical exercise apparatus as defined in claim 9, wherein said first and second guide tracks are fixedly attached to the frame on a sloped incline.

12. An elliptical exercise apparatus as defined in claim 11, wherein said first and second foot supports are rollably mounted on said first and second guide tracks respectively.

13. An elliptical exercise apparatus as defined in claim 9, wherein each of said first and second foot supports further comprises a foot engagement pad configured to receive the foot of a user.

14. An elliptical exercise apparatus as defined in claim 9, further comprising at least one arm support, wherein said at least one arm support is pivotally attached to the frame.

15. An elliptical exercise apparatus as defined in claim 14, wherein said at least one arm support is pivotally attached to one of either the first and second foot supports.

16. An elliptical exercise apparatus as defined in claim 3, wherein said foot engagement pads of the said first and second foot supports rotate about substantially elliptical paths.

17. An elliptical exercise apparatus comprising:

a frame;

first and second foot supports, wherein each of said first and second foot supports comprises a flexibly resilient leaf spring and a foot engagement pad configured to receive the foot of a user;

first and second guide tracks fixedly attached to the frame on an incline, wherein a first end of each of said first and second foot supports is rollably mounted on said first and second guide tracks respectively;

at least one arm support, wherein said at least one arm support is pivotally attached to both the frame and to the first end of either the first or second foot supports; and a crank, wherein said crank is pivotally connected to a second end of each of the first and second foot supports, such that each of the first and second foot supports moves in a substantially elliptical path.

18. An elliptical exercise apparatus as defined in claim 17, further comprising a second arm support.

19. An elliptical exercise apparatus as defined in claim 18, wherein each arm support comprises a larger diameter pole and a smaller diameter pole, and wherein the smaller diameter pole is slidably retractable into the larger diameter pole.

20. An elliptical exercise apparatus as defined in claim 17, wherein the leaf spring of each of the first and second foot supports is configured to flex in response to an application of force by the user, and wherein the first end of each of said first and second foot supports is at least partially displaced rollably along said first and second guide tracks, respectively, when the leaf springs of the first and second foot supports are flexed.

21. An elliptical exercise apparatus comprising:

a frame;

first and second foot supports, wherein each of said first and second foot supports comprises a flexibly resilient leaf spring and a foot engagement pad configured to receive the foot of a user;

first and second guide tracks fixedly attached to the frame on an incline, wherein a first end of each of said first and second foot supports is rollably mounted on said first and second guide tracks respectively;

at least one arm support, wherein said at least one arm support is pivotally attached to both the frame and to the first end of either the first or second foot supports;

a crank, wherein said crank is pivotally connected to the second end of each of the first and second foot supports, such that each of the first and second foot supports moves in a substantially elliptical path; and a second arm support, wherein each arm support comprises a larger diameter pole and a smaller diameter pole, and wherein the smaller diameter pole is slidably retractable into the lamer diameter pole.

22. An elliptical exercise apparatus as defined in claim 1, wherein the means for enabling elliptical movement is coupled to the frame and to the back end of the foot supports.

23. An elliptical exercise apparatus as defined in claim 13, wherein the crank is coupled to the frame and to the back end of the first and second foot supports.

* * * * *

UNITED STATES PATENT AND TRADEMARK OFFICE

CERTIFICATE OF CORRECTION

PATENT NO. : 6,875,160 B2
DATED : April 5, 2005
INVENTOR(S) : Scott R. Watterson and F. Troy Miller It is certified that error appears in the above-identified patent and that said Letters Patent is hereby corrected as shown below:

Column 1,
Line 41, change “gates” to -- gaits --.

Column 5,
Line 22, after “which are” remove “each”.

Column 6,
Line 37, change “20 and 22” to -- 21 and 23 --.
Line 60, before “collectively” insert -- 15 --.

Column 8,
Line 17, change “supports such that” to -- supports, such that --.
Line 40, change “claim 3” to -- claim 13 --.

Column 10,
Line 11, change “lamer” to -- larger --.

Signed and Sealed this

Twenty-ninth Day of November, 2005

JON W. DUDAS
*Director of the United States Patent and Trademark Office*